US005586736A

United States Patent [19]

Mollet

[11] Patent Number: 5,586,736

[45] Date of Patent: Dec. 24, 1996

[54] CAB SIGNAL SENSOR WITH NOISE SUPPRESSION

[75] Inventor: Samuel R. Mollet, Blue Springs, Mo.

[73] Assignee: Harmon Industries, Inc., Blue Springs, Mo.

[21] Appl. No.: 491,247

[22] Filed: Jun. 16, 1995

[51] Int. Cl.[6] ..... B61L 3/00

[52] U.S. Cl. ..... 246/194; 246/63 R

[58] Field of Search ..... 246/194, 63 A, 246/63 C, 63 R, 8

[56] References Cited

U.S. PATENT DOCUMENTS

| | | | |
|---|---|---|---|
| 2,071,056 | 2/1937 | Allison . | |
| 2,662,934 | 12/1953 | Allison . | |
| 3,060,311 | 10/1962 | Porter | 246/194 |
| 3,555,270 | 1/1971 | Persson . | |
| 4,081,160 | 3/1978 | Devy et al. . | |
| 4,508,298 | 4/1985 | Salmon . | |
| 4,720,067 | 1/1988 | Jaeger . | |
| 5,234,184 | 8/1993 | Chew . | |

FOREIGN PATENT DOCUMENTS

| | | | |
|---|---|---|---|
| 523434 | 8/1921 | France | 246/63 R |
| 286089 | 7/1914 | Germany | 246/63 R |
| 538726 | 4/1954 | Italy . | |
| 5603 | 3/1911 | United Kingdom | 246/194 |
| 23911 | 12/1911 | United Kingdom | 246/194 |
| 1065399 | 4/1967 | United Kingdom . | |

*Primary Examiner*—Mark T. Le
*Attorney, Agent, or Firm*—Chase & Yakimo

[57] ABSTRACT

Apparatus for sensing coded cab current information in a high level noise environment, caused by the magnetic fields of AC traction motors employed in the locomotive, utilizes pickup coils each having an upright axis and an axially extending, ferrite core. The coils are employed in pairs on a common magnetic structure located over an underlying rail, the coils being spaced apart horizontally and transversely of the rail. Magnetic flux resulting from the cab current is directed in opposite axial directions through the coils, whereas magnetic flux produced by the AC traction motors is directed through the coils in the same axial directions. This results in the addition of the voltages induced in the coils by the cab current, and voltage subtraction in response to the interfering magnetic field produced by the AC motors.

14 Claims, 8 Drawing Sheets

Fig. 3
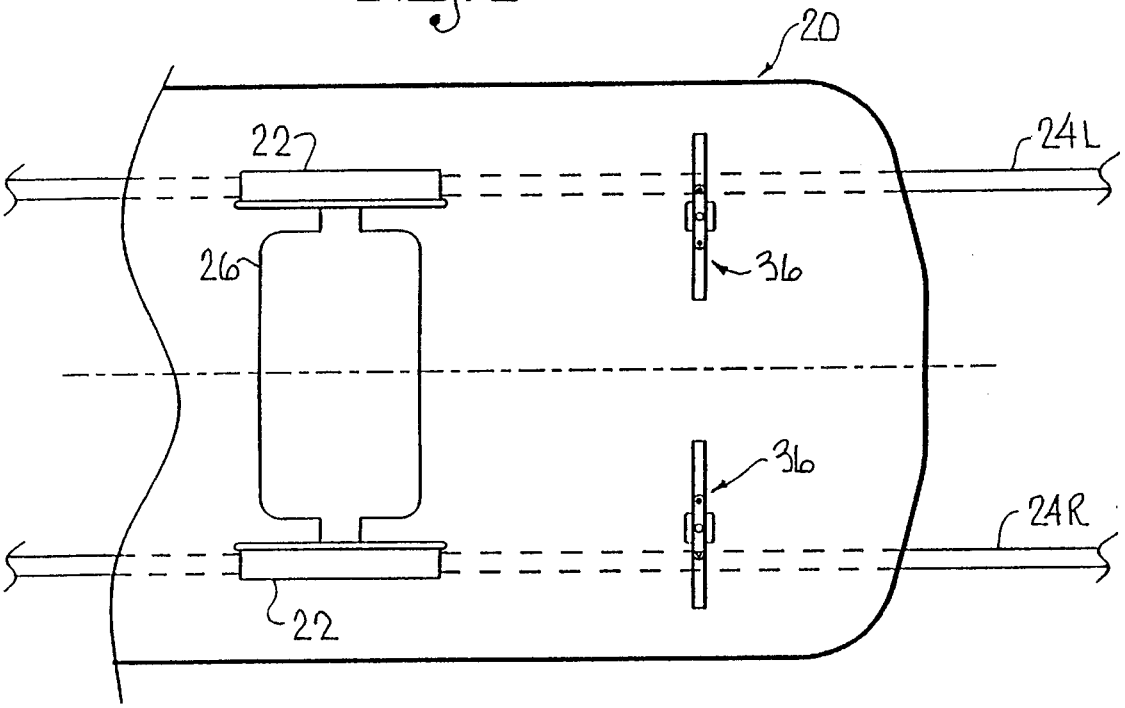
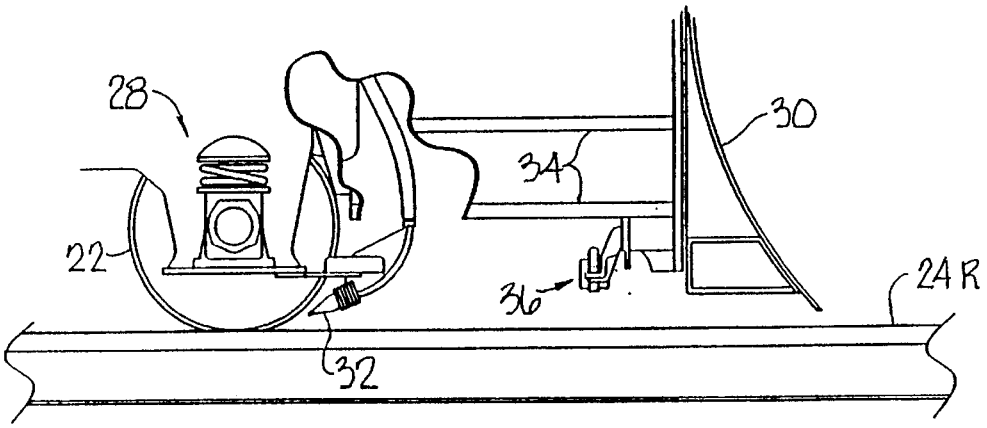
Fig. 4

CAB SIGNAL SENSOR WITH NOISE SUPPRESSION

BACKGROUND OF THE INVENTION

This invention relates to the detection of coded or modulated electrical currents that are transmitted through the rails of a railroad track for control purposes and, more particularly, to an improved inductive sensor which suppresses high level noise that would otherwise interfere with detection of the control information.

Railroad signalling has traditionally been based upon the concept of protecting zones of track, called "blocks," by means of some form of signal system that conveys information to the locomotive engineer about the status of the track ahead. Typically, wayside signal lights are located along the track and are controlled by electrical logic circuits responsive to the presence of trains and the status of blocks that are relevant to a given wayside signal. Each wayside signal is thus caused to display a pattern of lights, called the "aspect" of the signal, which is visible to the engineer in the locomotive and indicates the status at that location.

A more advanced signalling system in widespread use is referred to as cab signalling and may be used with or without wayside signal lights. In cab signalling the same logic that determines block status for display on the wayside signals is also used to generate one of several forms of encoded electrical current in the rails, block status being represented by the selection of the code rate used. Inductive pickup coils are mounted on the locomotive ahead of the lead wheels and just above the rails for the purpose of sensing the magnetic fields around the rails produced by the encoded current. In modern systems a computer on board the locomotive decodes the detected information to determine the status and indicates the proper aspect in the engine cab by a speed limit value display or a pattern of lights in the same manner as a wayside signal. One advantage, of course, is that the information is made available to the train crew on a continuous basis and updated immediately when changes in status occur, rather than restricting the communication of status information to periodic intervals along the track at which the engineer is required to observe and read the next wayside signal.

The pickup coils typically used in cab signal systems are iron core inductors employed in pairs, one being mounted above each rail. The carrier frequency of the coded cab current for freight operations is typically in the range of from 40 Hz to 100 Hz but may be as high as 250 Hz. Examples of modulation rates and corresponding aspects are, for example, discussed in U.S. Pat. No. 5,340,062, issued Aug. 23, 1994. The iron core of the pickup coil is relatively long, of the order of 30 inches, and extends horizontally and transversely over the underlying rail, the long core length being utilized both for high sensitivity and to assure that the coil will at all times overlie the rail irrespective of the position of the locomotive, e.g., lateral displacement of the locomotive body relative to the rails as the train traverses a curve.

Inductors of the above described type operate quite satisfactorily in diesel locomotives in which the engines drive direct current generators that, in turn, supply current to DC traction motors. However, modern diesel locomotives employ solid state switching that has made the use of alternating current traction motors possible and eliminated the high maintenance requirements associated with the use of direct current motors. The alternating current frequency can vary from approximately 20 Hz to 300 Hz in accordance with rotor speed as dictated by the speed requirements of the train. This results in the generation of an alternating current magnetic field by the AC traction motors that did not exist in the direct current powered locomotives. Being in the same frequency range as the cab signal carrier, the AC traction motors, in effect, are a source of high level noise which is received by the horizontal core pickup coils along with the coded cab current and renders them unusable as a reliable control information sensor.

SUMMARY OF THE INVENTION

It is, therefore, the primary object of the present invention to provide a control information sensor for use in cab signalling which has a sufficiently high signal-to-noise ratio that it may be utilized in locomotives powered by AC traction motors.

Another important object of the invention is to provide a sensor as aforesaid in which a pair of pickup coils adjacent an underlying rail are interconnected and positioned in a manner to suppress the voltage induced therein in response to the magnetic field produced by the AC traction motors.

Another important object is to provide such a sensor in which voltages induced in the pickup coils by the magnetic field produced by the control information are added, and voltages induced in the coils by the magnetic field produced by the AC traction motors are subtracted to thereby suppress the interfering noise and provide a high signal-to-noise ratio.

Still another object of this invention is to provide pickup coils for such sensors which are horizontally spaced transversely of the underlying rail, each coil having an upright axis and an axially extending magnetic core so that magnetic flux resulting from the cab current is directed in opposite axial directions through the respective coils, and magnetic flux produced by the AC traction motors is directed through the coils in the same axial directions.

Still another important object of this invention is to provide a sensor as aforesaid in which a flux path is established between a pair of upright pickup coils.

Yet another important object is to provide a sensor that includes an inverted, generally U-shaped magnetic structure having a pair of legs presenting the cores of the pickup coils, and a cross member spanning the legs to provide a flux path therebetween.

A further object of the invention is to provide a sensor having a magnetic structure as aforesaid which is positioned over an underlying rail with the legs extending downwardly from the cross member and spaced transversely of the underlying rail, whereby voltage addition occurs in the coils in response to magnetic flux directed in opposite directions along the respective legs, and voltage subtraction occurs in response to magnetic flux directed along the legs in the same direction.

Furthermore, it is an important object of the present invention to provide a control information sensor employing a pair of pickup units for sensing magnetic fields around the respective rails produced by the control information, wherein each of the units employs a pair of upright coils as aforesaid to accomplish addition of voltages induced by the control information and subtraction, and hence suppression, of voltages induced by the AC traction motors.

Further objects include providing pickup coils in each unit having numbers of turns on their respective cores selected to maximize voltage subtraction and thus suppression of interfering noise, and providing a sensor apparatus having an output characteristic in which the output voltage component resulting from the received noise is very low and essentially flat irrespective of the strength of the noise field.

Other objects will become apparent as the detailed description proceeds.

DESCRIPTION OF THE DRAWINGS

FIG. 3 is a view similar to FIG. 1 but showing the pickup coils of the prior art for comparison purposes.

FIG. 4 is a view similar to FIG. 2, but showing the prior art pickup coils illustrated in FIG. 3.

DETAILED DESCRIPTION

Figure 1:
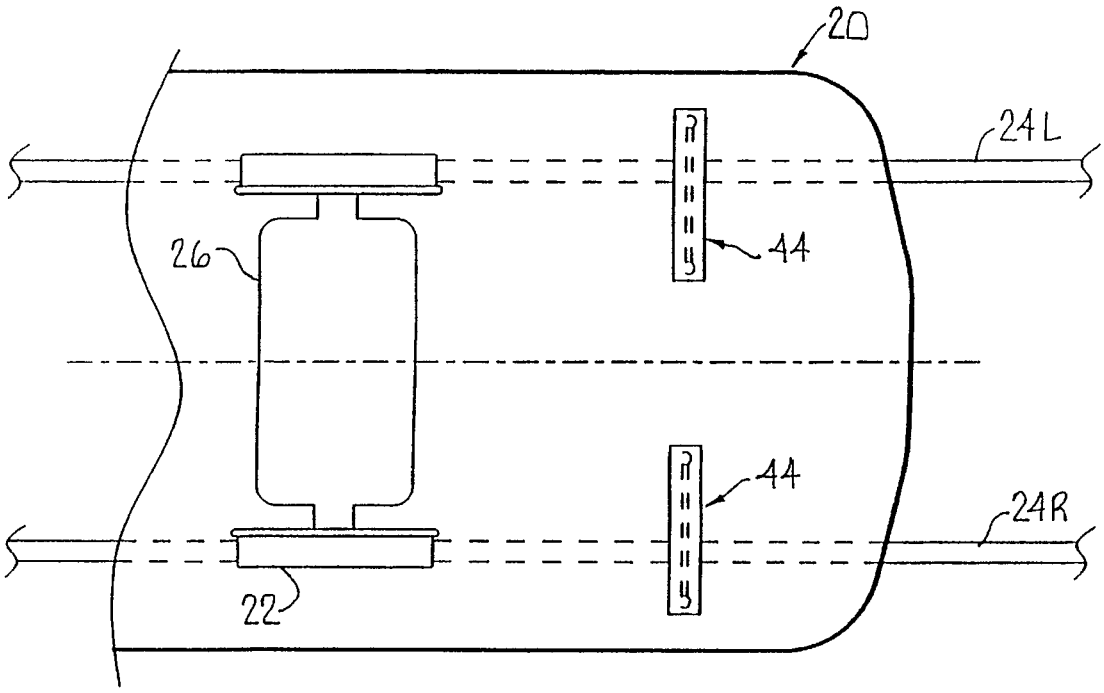
FIG. 1 is a fragmentary, diagrammatic plan view of the forward portion of a locomotive showing the lead wheels and traction motor, and the pickup units of the sensor apparatus of the present invention.
Figure 2:
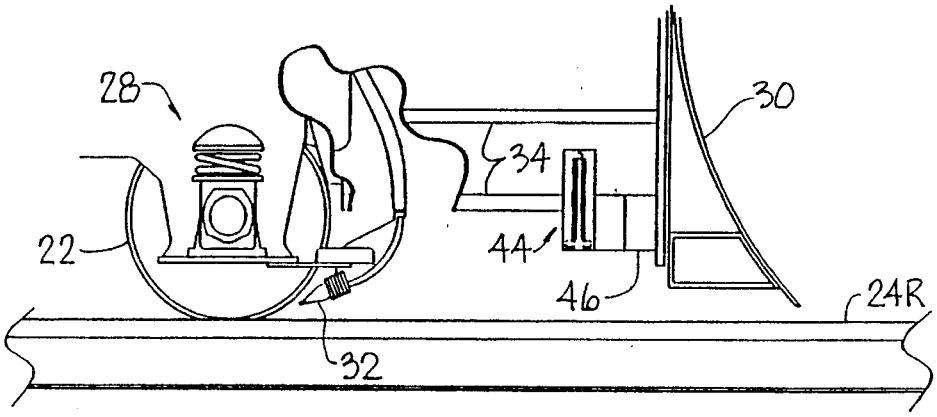
FIG. 2 is a partial, diagrammatic side view of the portion of the locomotive shown in FIG. 1, parts being broken away for clarity.

Referring initially to FIGS. 1–4, the front end of a locomotive 20 is diagrammatically illustrated and has a pair of lead wheels 22 in rolling contact with respective underlying rails 24L and 24R, the notation "L" and "R" referring to left and right respectively looking down the track in the direction of travel of locomotive 20. An alternating current traction motor and associated gearbox 26 is located between the wheels 22 with opposite ends of its output shaft coupled with the wheels in the usual manner. The drive assembly comprising the motor 26 and wheels 22 is mounted on a truck 28 in the conventional manner, a portion of the truck 28 being shown in FIGS. 2 and 4. Other standard components that may be seen include a plow 30, the nozzle 32 of a sander, and steps 34 behind the plow 30. Except for the addition of the sensor apparatus of the present invention to be discussed, the locomotive fragmentarily portrayed in FIGS. 1–4 is in all respects a conventional diesel locomotive of present day design employing AC traction motors, including the motor 26, to drive the lead wheels 22 and additional pairs of wheels therebehind which are not shown. (It should be understood that FIGS. 1–4 are not to scale; the motor 26 and wheels 22 are considerably reduced in size for illustrative purposes.)

Figure 5:
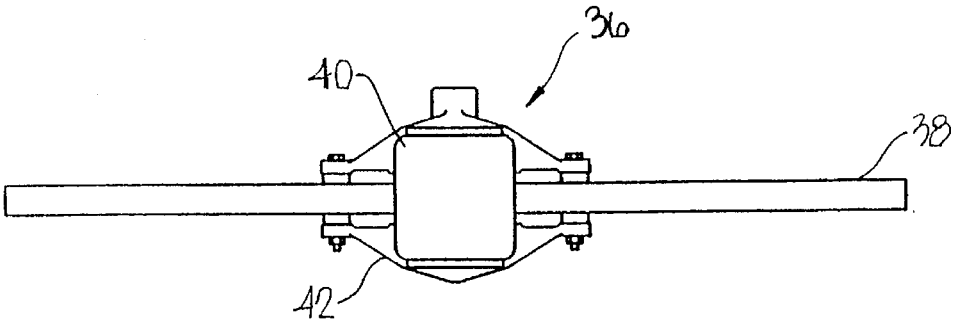
FIG. 5 is an enlarged view of the prior art pickup coil alone shown in an operative position above an underlying rail, as seen in elevation looking down the track.
Figure 5:
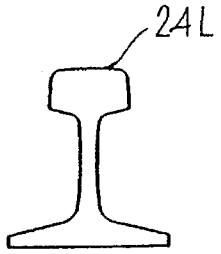

A pair of pickup coils 36, of a prior type employed on locomotives powered with direct current traction motors, are illustrated in FIGS. 3 and 4 in representative positions over corresponding rails 24L and 24R and one is shown in detail in FIG. 5. The prior art coils 36 form a part of a cab signal system and are used to sense the magnetic fields around the rails 24L and 24R produced by the coded cab current flowing in the rails, a circuit for the current flow being completed by a short across the rails resulting from the presence of a train which effectively interconnects the two rails 24L and 24R by creating a current path through the metallic wheels and axle components. The pickup coils 36 are typically mounted beneath the frame of the locomotive 20 forward of the lead truck 28, the relative position of one of the coils 36 relative to the associated rail being evident from a comparison of FIGS. 3 and 5.

The pickup coil 36 of the prior art has a long horizontal iron core 38 typically about 30 inches in length (FIG. 5). An encapsulated center portion 40, midway along the length of the core 38, contains the windings of the coil about the core 38. The encapsulated windings 40 and core 38 are secured mechanically by a clamp 42, and the assembly is attached to the frame of the locomotive. As may be appreciated from viewing FIG. 5, the longitudinal axis of the core 38 extends horizontally above the underlying rail 24L (typically spaced about 9.5 inches above the top of the rail). As locomotive 20 undergoes lateral displacement with respect to rails 24L and 24R along curves in the track, the horizontal reach of the core 38 assures that some portion of the core will at all times be directly above the associated rail. Although the long core length provides a sensitive pickup and assures that the coil will at all times overlie the rail, it is unsatisfactory as a pickup in locomotives powered with AC traction motors as the horizontal core is also highly responsive to the AC magnetic fields produced by the motors. As previously discussed, the AC motors are, therefore, a source of high level noise in the same frequency range as the carrier frequencies typically employed in the transmission of the coded cab current through the rails.

Figure 6:
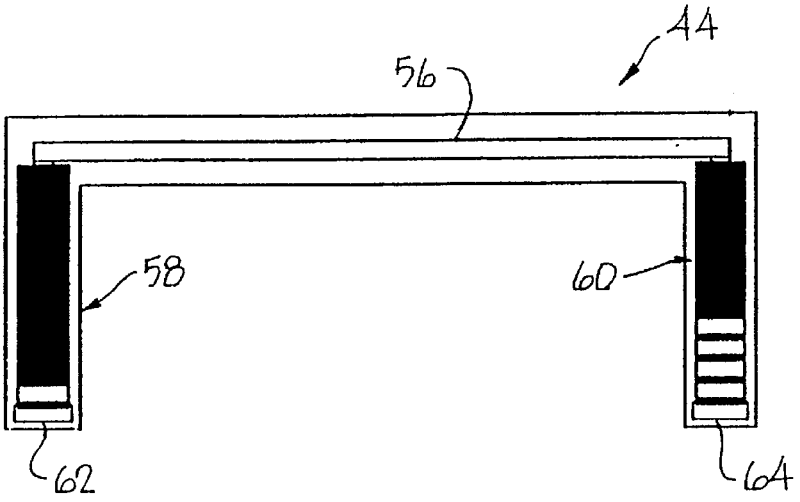
FIG. 6 is a diagrammatic illustration of one of the pickup units of the present invention shown in an operative position above an underlying rail, as seen in elevation looking down the track.
Figure 6:
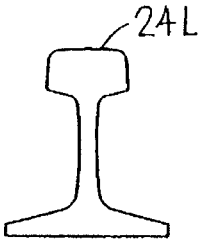
Figure 7:
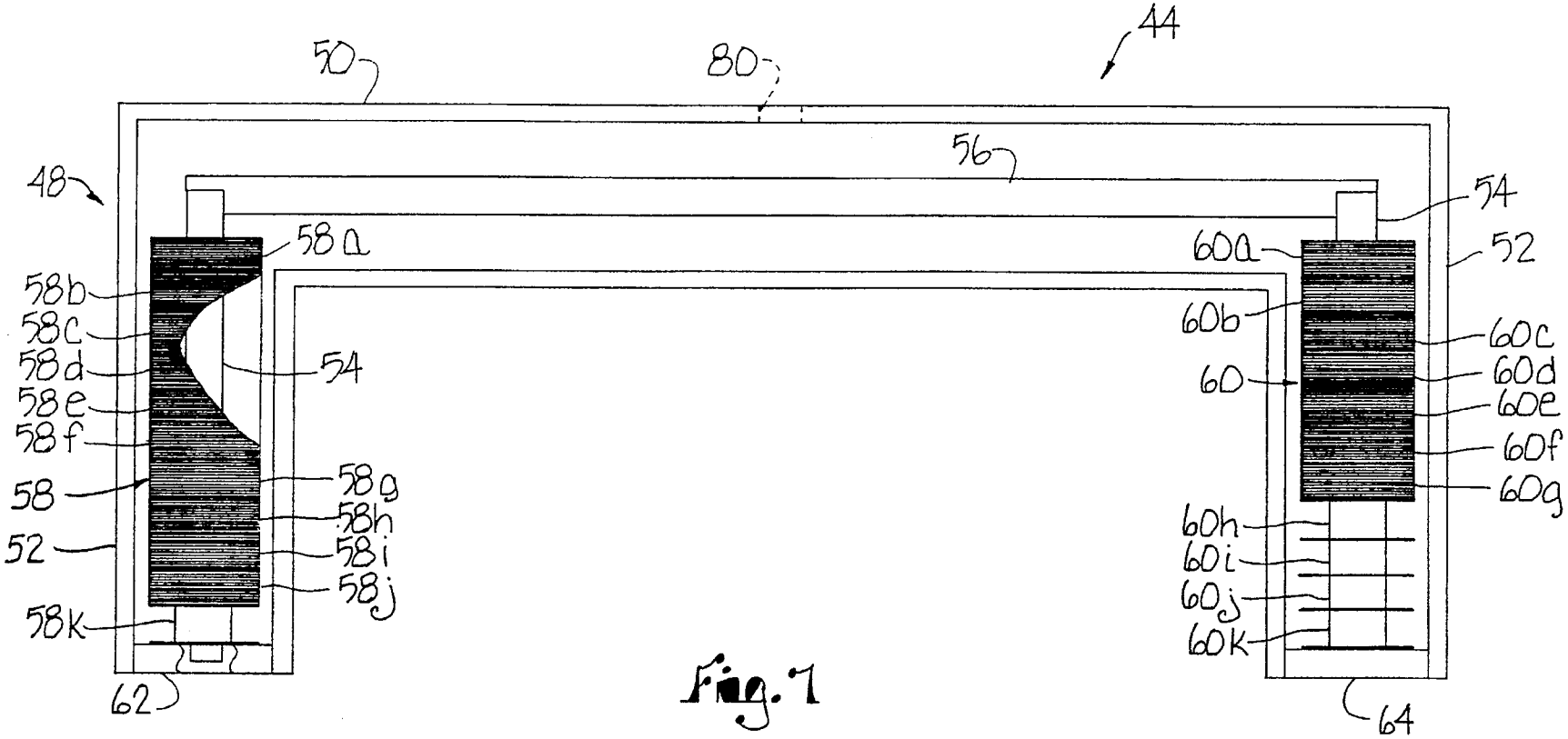
FIG. 7 is a front view of one of the pickup units showing the construction of the magnetic structure and the coils, parts being broken away for clarity.
Figure 8:
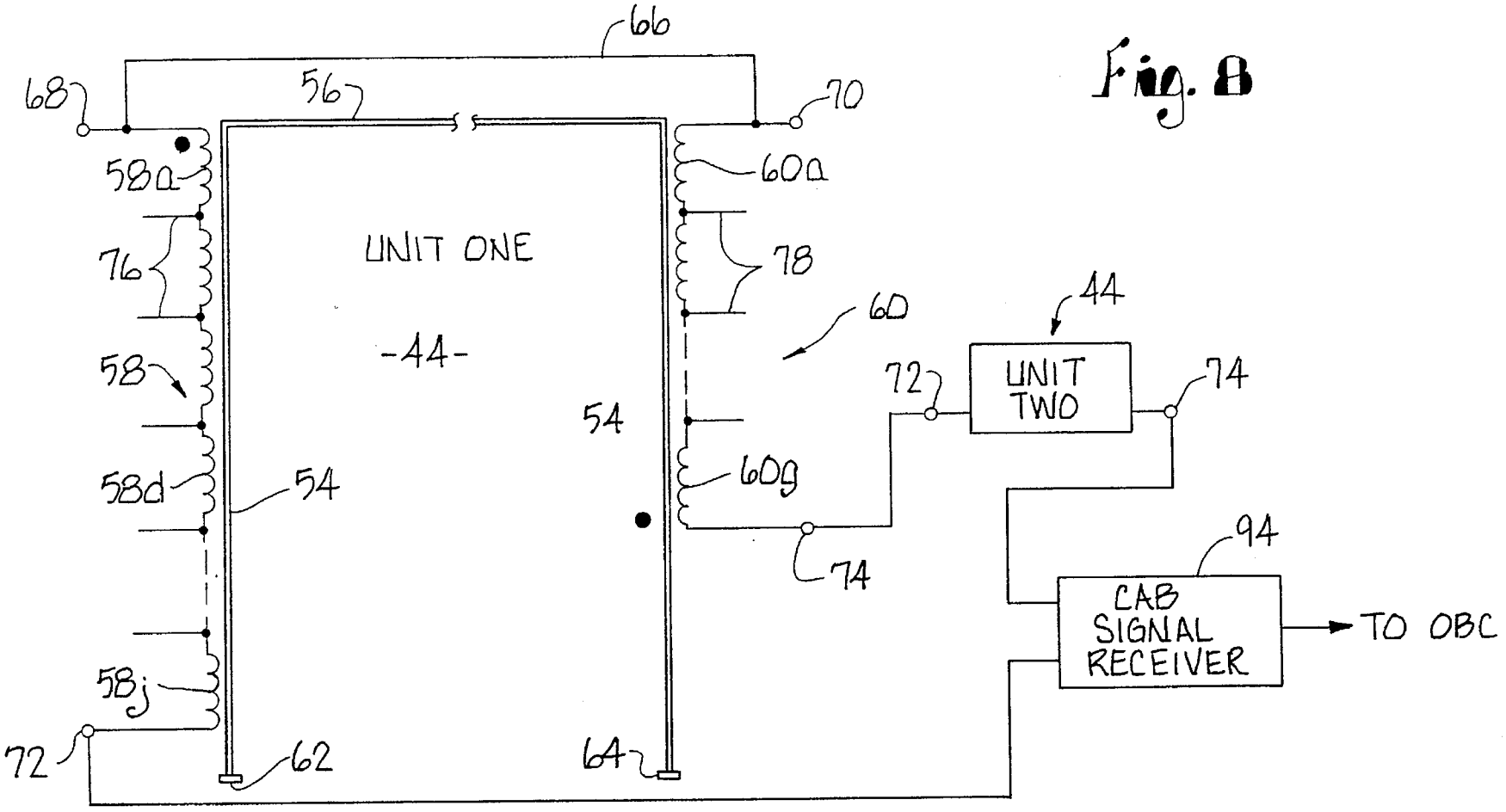
FIG. 8 is a simplified electrical diagram of the sensor apparatus.

Referring to FIGS. 1, 2 and 6–8, pickup units 44 of the sensor apparatus of the present invention are illustrated in relation to the rails 24L and 24R and are shown in detail, structurally and electrically, in FIGS. 7 and 8. Each of the units 44 is mounted on the locomotive 20 behind the plow 30 above a corresponding rail 24L or 24R by a suitable bracket 46. Accordingly, two pickup units 44 are employed in the present invention above the rails 24L and 24R as may be appreciated from a comparison of FIGS. 1 and 2. One of the units 44 is shown diagrammatically in FIG. 6 where it may be seen that the unit 44 is of inverted, U-shaped configuration and, when the locomotive 20 is on a straight stretch of track, is somewhat laterally offset with respect to the underlying rail 24L (the outside end is on the left as viewed in FIG. 6).

Each of the units 44 is of identical construction and one is shown in detail in the front view of FIG. 7. A housing 48 composed of a nonmagnetic substance, such as aluminum or a plastic material, has a rectangular configuration but for the missing lower side and thus presents an inverted, hollow U-shaped enclosure for the active components of the unit 44. Housing 48 during assembly of the unit 44 presents a channel having a top segment 50 communicating with a pair of end segments 52 disposed at right angles thereto, the lower ends of the segments 52 being open. Each of the channel segments 50 and 52 is U-shaped in transverse cross-section to leave the front of the housing 48, seen in FIG. 7, open to facilitate the mounting of the active components of the unit 44 therein. Once completely assembled, the entire housing 48 may be filled with an epoxy resin to completely encapsulate the active components.

An inverted, U-shaped magnetic structure is disposed in housing 48 and is essentially centered within the top and end segments 50 and 52. The magnetic structure comprises a pair of vertical legs 54 and a horizontal cross member 56 spanning the upper ends of the legs 54 to present a continuous magnetic circuit from the lower end of one leg 54 to the lower end of the other leg 54. Three cylindrical ferrite rods are employed to provide the legs 54 and cross member 56, the upper ends of the leg rods and the associated ends of the horizontal cross rod being joined by an adhesive. Suitable lengths are eight inches for each leg 54 and twenty inches for cross member 56.

A pickup coil 58 is wound on the left leg 54 (as viewed in FIG. 7) by coaxially stacking a number of bobbins of wire thereon and, in similar fashion, a pickup coil 60 is formed on right leg 54 by a stack of bobbins. In particular, coil 58 is formed by eleven bobbins installed on left leg 54 in coaxial relationship therewith, the eleven bobbins being denoted 58*a* through 58*k* from top to bottom. Each of the bobbins 58*a* through 58*j* contains, for example, three thousand turns of No. 34 wire. The bottom bobbin 58*k* is empty and thus serves as a spacer between the active coil bobbins 58*a*–58*j* and a ferrite disk or foot 62 secured to the lower end of left leg 54 at the open bottom of housing segment 52. As may be appreciated from the schematic diagram of FIG. 8, the coils of bobbins 58*a* through 58*j* are connected in series to form the pickup coil 58.

The coil construction for pickup coil 60 is identical to coil 58 except for the number of active bobbins. Eleven bobbins 60*a* through 60*k* are coaxially stacked on right leg 54, but the lower four bobbins are empty and thus serve only as spacers between the seven wire-containing bobbins 60*a*–60*g* and a ferrite foot 64 identical to the foot 62 at the lower end of coil 58. The difference electrically between the two pickup coils 58 and 60 is reflected in FIG. 8, and the purpose of this imbalance will be discussed below.

Electrical connections to the various bobbins of wire forming the pickup coils 58 and 60 are shown in FIG. 8 for one of the units 44 ("unit one"). The upper ends of the two coils 58 and 60 are interconnected by a lead 66. These upper ends also present common output terminals 68 and 70 respectively. The bottom ends of the two coils 58 and 60 (wire bobbins 58*j* and 60*g*) present output terminals 72 and 74 respectively. The pickup coils 58 and 60 are thus connected in series and in phase as the notation indicates. It may be appreciated that the ferrite legs 54 provide high permeability cores for the coils 58 and 60 and that the cores are interconnected at their upper ends, as described above, by the ferrite cross member 56.

If desired, taps between the interconnected bobbins of wire may be provided as shown in FIG. 8 at 76 for coil 58 and at 78 for coil 60 in order to change the point on each coil where an output is taken. The output terminals 68, 70, 72 and 74 and taps 76 and 78 may be connected to a cable (not shown) installed in housing 48 before encapsulating the components, which may extend from housing 48 through an opening 80 in top segment 50 (FIG. 7).

FIG. 6 illustrates the pickup coils 58 and 60 diagrammatically and shows them within one of the units 44, the wire-containing bobbins being shaded and the empty bobbins and feet 62 and 64 being unshaded. The vertical distance from a horizontal plane at the top of rail 24L to the bottom surfaces of the feet 62 and 64 may be of the order of seven inches. As the locomotive 20 traverses curves in the track, the unit 44 shifts from side to side relative to the rail 24L with the outside coil 58 being directly over the rail 24L (or slightly inside) in an extreme condition during a sharp turn.

Figure 9:
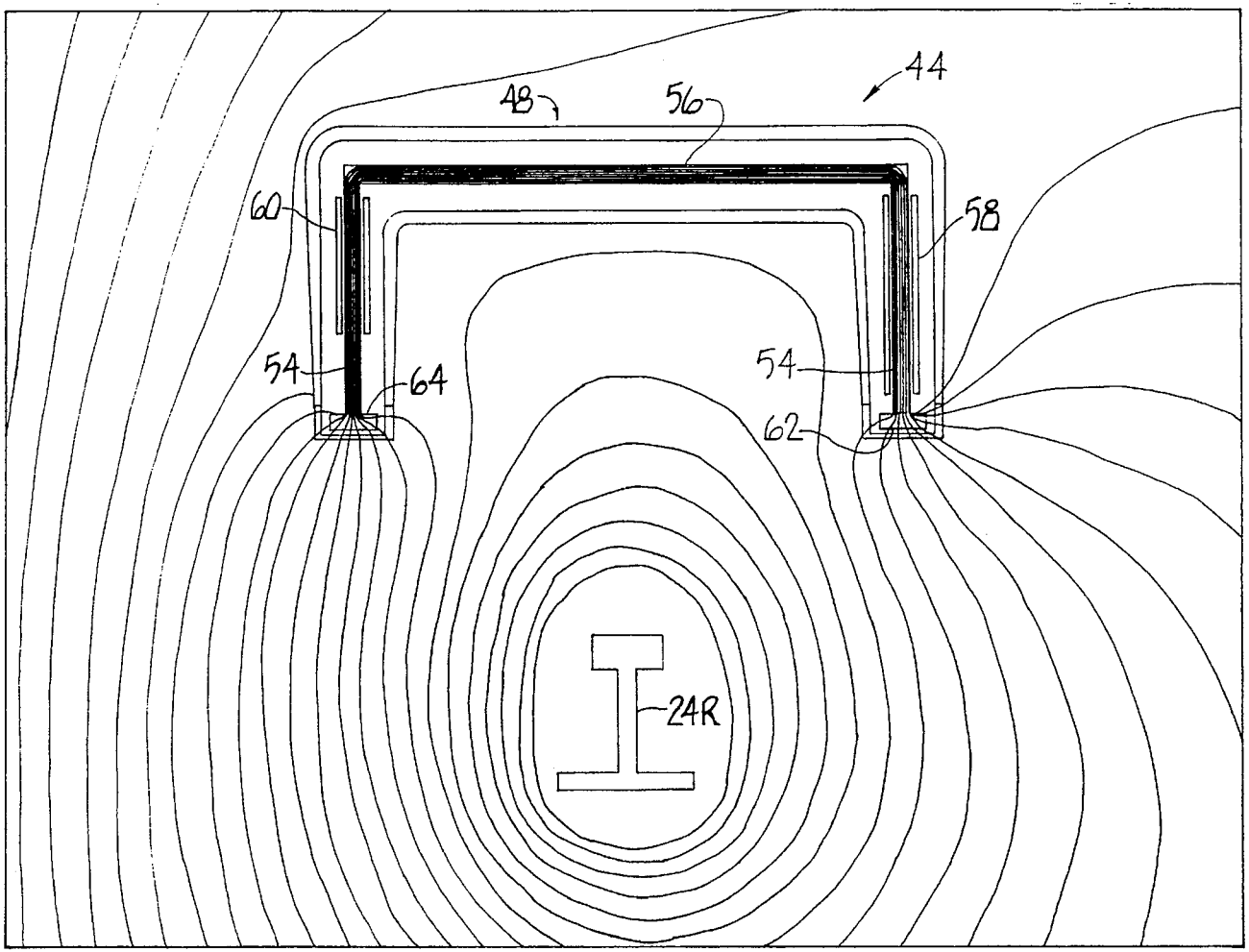
FIG. 9 illustrates the circular magnetic field around a rail and the lines of induction through the overlying pickup unit.

FIG. 9 illustrates the circular magnetic field around the rail 24R and its relationship to the overlying pickup unit 44 at a time when the unit is centered over the rail. The active components of the unit (magnetic structure and pickup coils) are shown schematically within the nonmagnetic housing 48. It may be appreciated from viewing FIG. 9 that the lines of induction are concentrated within the ferrite legs 54 presenting the cores of the outside coil 58 (on the right in FIG. 9) and the inside coil 60, and that the magnetic flux is directed in a circular fashion through the pickup unit 44 via the series magnetic circuit formed by the legs 54 and the interconnecting cross member 56. The magnetic field illustrated is representative of the field produced by the cab current flowing in each of the rails 24L and 24R which, of course, bears the control information that the sensor apparatus of the present invention is to detect.

Figure 10:
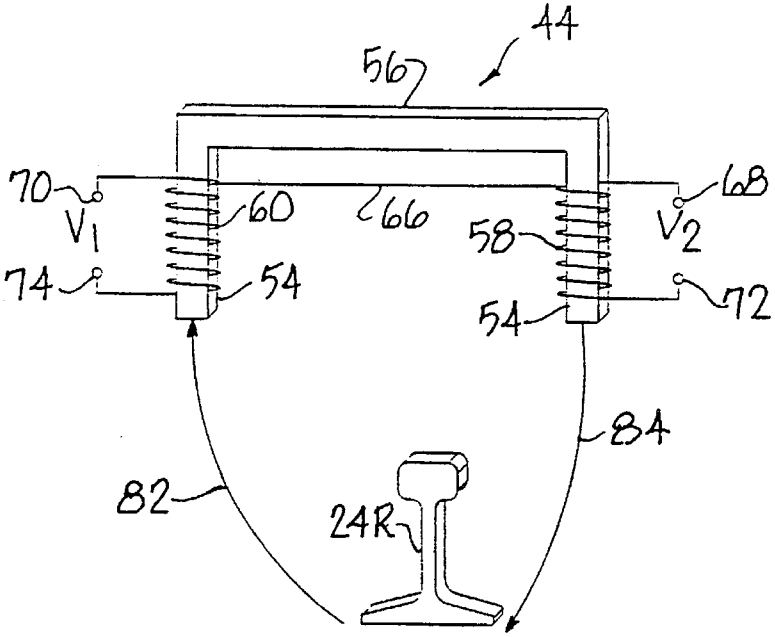
FIG. 10 is a simplified, schematic illustration of a pickup unit and associated rail, and the direction of the magnetic flux resulting in addition of the induced voltages in the coils.

FIG. 10 is a simplified illustration of the manner in which voltages are induced in the pickup coils 58 and 60 by the magnetic field around rail 24R. The magnetic flux at a given instant is represented by arrow 82 entering the bottom of left (inside) leg 54, and arrow 84 emanating from the bottom of right (outside) leg 54. Representative equations for $V_1$ and $V_2$ are as follows:

$$V_1 = N_1 \cdot \frac{d\Psi_{CAB1}}{dt}$$

$$V_2 = N_2 \cdot \frac{d\Psi_{CAB2}}{dt}$$

where $V_1$ is the voltage across output terminals 70 and 74, $V_2$ is the voltage across output terminals 68 and 72, N1 and N2 are the number of turns in coils 60 and 58 respectively, $\Psi_{CAB1}$ is the magnetic flux in Webers directed upwardly through left leg 54 represented by arrow 82, and $\Psi_{CAB2}$ is the magnetic flux in Webers directed downwardly through right leg 54 represented by arrow 84. As the two coils 58 and 60 are connected in an additive relationship (in phase), the total voltage output from the pickup unit 44 is the sum of $V_1$ and $V_2$.

Figure 11:
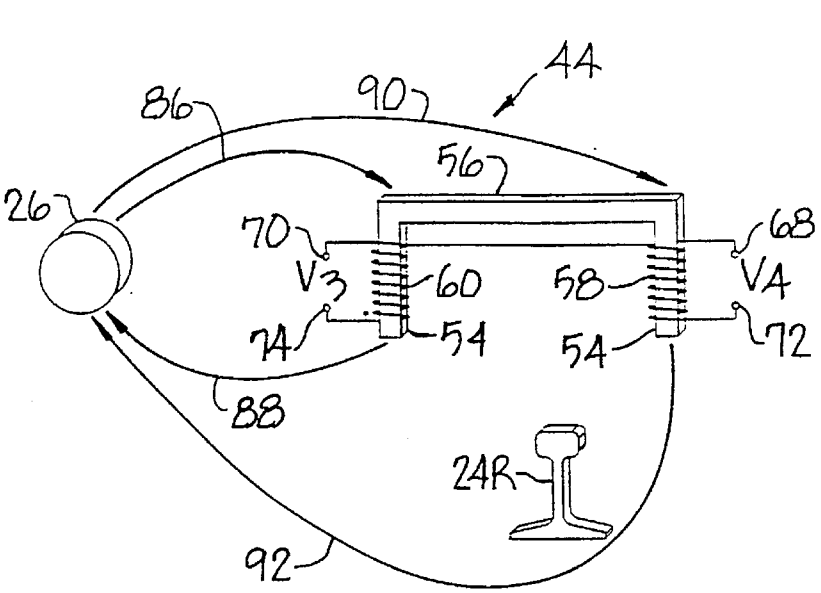
FIG. 11 is a simplified, schematic illustration of a pickup unit and rail in relation to an AC traction motor, and the direction of the magnetic flux resulting in voltage subtraction in the present invention.

FIG. 11 is a simplified illustration of the magnetic field produced by traction motor 26. As represented by arrows 86 and 88, the magnetic flux at a given instant is directed circularly through left (inside) leg 54 from top to bottom. Likewise, as represented by arrows 90 and 92, the flux is directed through right (outside) leg 54 from top to bottom. Accordingly, in the case illustrated in FIG. 11, the magnetic flux is directed along the legs or cores 54 in the same axial directions (downwardly) whereas in the case presented in FIG. 10 the flux is directed through legs 54 in opposite axial directions. Representative equations for the FIG. 11 case are:

$$V_3 = N_1 \cdot \frac{d\Psi_{NOISE1}}{dt}$$

$$V_4 = N_2 \cdot \frac{d\Psi_{NOISE2}}{dt}$$

where $V_3$ is the voltage produced at output terminals 70 and 74 by the noise field, $V_4$ is the voltage at output terminals 68 and 72, N1 and N2 are the turns of coils 60 and 58 respectively, $\Psi_{NOISE1}$ is the flux in Webers represented by arrows 86 and 88, and $\Psi_{NOISE2}$ is the flux in Webers represented by the arrows 90 and 92. However, if $V_3$ and $V_4$ are equal, then the algebraic sum of the two voltages is zero as voltage subtraction occurs in the magnetic circuit of unit 44.

It has been found in order to optimize voltage subtraction and hence suppression of the noise signal in the sensor output, fewer turns are provided on the inside coil 60 of the pickup unit as shown and described herein where 10 bobbins of wire comprise coil 58 and seven bobbins of wire comprise coil 60. This relationship may vary from locomotive to locomotive, and thus the taps 76 and 78 are provided for this purpose.

Utilization of two pickup units 44 over both rails 24L and 24R increases the voltage output of the sensor apparatus. Referring to FIG. 8, terminal 74 of one of the units 44 (unit one) is connected to terminal 72 of the other unit 44 (unit two) to connect the units in series. The output is then taken from terminal 72 of unit one and terminal 74 of unit two. The output voltage thus obtained provides an input to a cab signal receiver 94 on board the locomotive 20. As is conventional, the receiver 94 decodes the coded cab current information and feeds such information to an on board computer (OBC) which operates the aspect display (not shown) and in advanced systems executes automatic control functions as appropriate.

Figure 12:
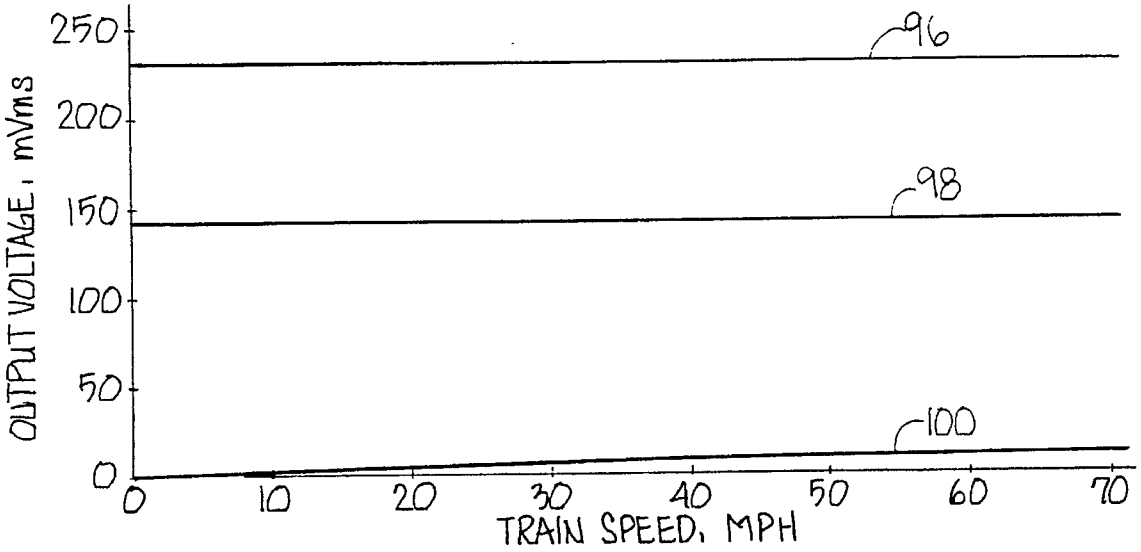
FIG. 12 is a graph illustrating the performance of the sensor apparatus over a range of train speed.

The results of a test of the performance of the sensor apparatus on a General Motors locomotive, EMD Model SD60M-AC, is depicted in the graph of FIG. 12. The uppermost line 96 is the output voltage of the apparatus (approximately 230 millivolts) produced in response to a 60 Hz cab current in the rails of 575 milliamperes. The output remained relatively constant over the entire range of train speed from 0 to 70 mph. Similarly, the center graph line 98 shows a constant output voltage of approximately 140 millivolts produced in response to a 100 Hz cab current of 375 milliamperes. The lowermost graph line 100 is the output voltage component (noise component) produced in response to the interfering magnetic fields from the AC traction motors of the locomotive. The noise component was at level of approximately 9 millivolts at 40 mph (corresponding to an approximately 60 Hz magnetic field) and increased only slightly with increasing train speeds. At 70 mph the noise field has a frequency of approximately 100 Hz.

Figure 13:
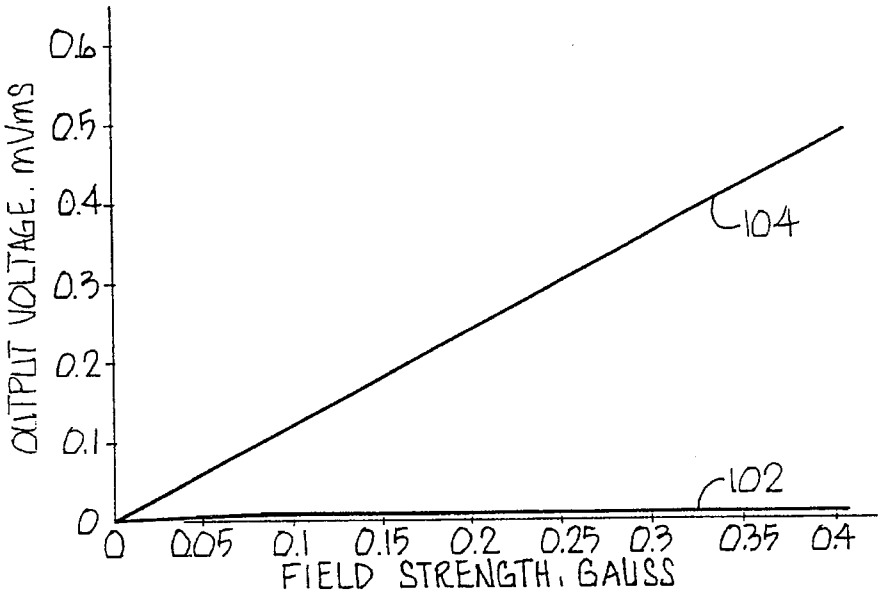
FIG. 13 is a graph showing the output of the sensor apparatus and the signal-to-noise ratio.

The high signal-to-noise ratio obtained in the instant invention is further illustrated in FIG. 13 which shows the results of a laboratory test representative of actual conditions, output voltage in millivolts rms being plotted against field strength in Gauss. As shown by the lower graph line 102, the output voltage component resulting from the received noise was very low and remained essentially flat irrespective of the strength of the noise field. The output voltage characteristic 104 bearing the control information, however, increased in proportion to the strength of the magnetic field produced by the cab current and was approximately 25 times the magnitude of the noise voltage component at a field strength of 0.4 Gauss for each of the fields.

Having thus described the invention, what is claimed as new and desired to be secured by Letters Patent is as follows:

1. In a cab signal system having a receiver on board a locomotive and in which control information transmitted through the rails to the locomotive utilizes a carrier having a frequency in a predetermined range, wherein the locomotive employs an alternating current drive motor that emits high level noise by producing a magnetic field in said frequency range, the improvement comprising:

a pair of horizontally spaced pickup coils for sensing a magnetic field around one of the rails produced by said control information, each of said coils having an upright axis and an axially extending, magnetic core component, means interconnecting said core components for establishing a flux path therebetween, means for mounting said pickup coils on said locomotive in an environment in which said noise is present but in operative positions closely spaced from an underlying rail and with the coils spaced transversely thereof, means interconnecting said coils in a manner to provide voltage addition in response to the magnetic field produced by said control information, and voltage subtraction in response to said noise, and input circuit means for said receiver operably connected to said coils, whereby to suppress interfering noise from the drive motor and deliver sensed information to the receiver.

2. The improvement as claimed in claim 1, wherein said means interconnecting the coils provides said voltage addition in response to magnetic flux directed in opposite axial directions through the respective coils, and provides said voltage subtraction in response to magnetic flux directed through said coils in the same axial directions.

3. The improvement as claimed in claim 1, wherein said core components are composed of a high permeability material.

4. The improvement as claimed in claim 1, wherein said core components present upper and lower ends, and wherein said flux path establishing means includes a magnetic member spanning the upper ends of said core components.

5. The improvement as claimed in claim 4, wherein said core components and magnetic member are composed of a high permeability material.

6. In a cab signal system having a receiver on board a locomotive and in which control information transmitted through the rails to the locomotive utilizes a carrier having a frequency in a predetermined range, wherein the locomotive employs an alternating current drive motor that emits high level noise by producing a magnetic field in said frequency range, the improvement comprising:

first and second pickup units for sensing magnetic fields around the rails produced by said control information, each of said units including a pair of horizontally spaced coils each having an upright axis and an axially extending, magnetic core component, and means interconnecting said core components for establishing a flux path therebetween, means for mounting said pickup units on said locomotive in an environment in which said noise is present but in operative positions closely spaced from corresponding underlying rails with the coils of each unit spaced transversely of the underlying rail, each of said units further including means interconnecting said pair of coils thereof in a manner to provide voltage addition in response to the magnetic field produced by said control information, and voltage subtraction in response to said noise, and input circuit means for said receiver operably connected to said pickup units, whereby to suppress interfering noise from the drive motor and deliver sensed information to the receiver.

7. The improvement as claimed in claim 6, wherein said means interconnecting the coils in each unit provides said voltage addition in response to magnetic flux directed in opposite axial directions through the respective coils, and provides said voltage subtraction in response to magnetic flux directed through said coils of the unit in the same axial directions.

8. The improvement as claimed in claim 6, wherein said core components are composed of a high permeability material.

9. The improvement as claimed in claim 6, wherein said core components present upper and lower ends, and wherein said flux path establishing means includes a magnetic member spanning the upper ends of said core components.

10. The improvement as claimed in claim 9, wherein said core components and magnetic member are composed of a high permeability material.

11. In a cab signal system having a receiver on board a locomotive and in which control information transmitted through the rails to the locomotive utilizes a carrier having a frequency in a predetermined range, wherein the locomotive employs an alternating current drive motor that emits high level noise by producing a magnetic field in said frequency range, the improvement comprising:

a pickup unit for sensing a magnetic field around one of the rails produced by said control information, including a generally U-shaped magnetic structure having a pair of legs and a cross member spanning said legs, and a pair of pickup coils on respective legs, each of said legs presenting a magnetic core for the corresponding coil, means for mounting said pickup unit on said locomotive in an environment in which said noise is present and in closely spaced relationship to an underlying rail, and in an operative position in which said U-shaped structure is inverted and said legs thereof extend downwardly from said cross member and are spaced transversely of the underlying rail, thereby spacing said coils transversely of the underlying rail, means interconnecting said coils in a manner to provide voltage addition in response to the magnetic field produced by said control information, and voltage subtraction in response to said noise, and input circuit means for said receiver operably connected to said coils, whereby to suppress interfering noise from the drive motor and deliver sensed information to the receiver.

12. The improvement as claimed in claim 11, wherein said means interconnecting the coils provides said voltage addition in response to magnetic flux directed in opposite directions along respective legs through the respective coils, and provides said voltage subtraction in response to magnetic flux directed along the legs and through the coils in the same direction.

13. The improvement as claimed in claim 11, wherein said coils have numbers of turns on their respective cores selected to maximize said voltage subtraction and thus suppression of said noise.

14. The improvement as claimed in claim 11, wherein said magnetic structure is composed of a high permeability material.

* * * * *